US008258330B1

(12) United States Patent
Harting Glade et al.

(10) Patent No.: US 8,258,330 B1
(45) Date of Patent: Sep. 4, 2012

(54) CARRIER FLUID COMPOSITION COMPRISING FATTY ACIDS ETHYL ESTERS AND PROCESS FOR REDUCING THE CONCENTRATION OF PERSISTENT ORGANIC POLLUTANTS IN FISH OIL

(75) Inventors: Thomas Francis Harting Glade, Quilcura (CL); Miguel Angel Fuenzalida Diaz, Quilcura (CL); Alejandro Markovits Rojas, Quilcura (CL)

(73) Assignee: Naturalis, S.A., Santiago (CL)

( * ) Notice: Subject to any disclaimer, the term of this patent is extended or adjusted under 35 U.S.C. 154(b) by 0 days.

(21) Appl. No.: 13/343,348

(22) Filed: Jan. 4, 2012

(51) Int. Cl.
*C11B 3/00* (2006.01)

(52) U.S. Cl. ..... 554/204

(58) Field of Classification Search ..... 554/204
See application file for complete search history.

(56) References Cited

U.S. PATENT DOCUMENTS 6,469,187 B1 10/2002 Craven et al.
7,718,698 B2 5/2010 Breivik et al.
7,732,488 B2 6/2010 Breivik et al.

FOREIGN PATENT DOCUMENTS

EP 1 523 541 12/2009

OTHER PUBLICATIONS

Archive—MAFF—Food Surveillance Information Sheet "MAFF UK—Dioxins and Polychlorinated Biphenyls in Fish Oil Dietary Supplements and Licensed Medicines." mhtml:file://C:\IE_Temp\Content.Outlook\YS4ISXBF\ARCHIVE-Food Surveillance retrieved Feb. 5, 2012.

45.4.10—Vitamins and Other Nutrients/Nutritionally Related Components: AOAC Official Method 994.10 Cholesterol in Foods—Direct Saponification—Gas Chromatographic Method First Action 1994. http://file://C:\Documents%20and%20Settings\Stanley%20Tarka\Local%20Settings\Temporary retrieved Nov. 21, 2003.

Fernandes et al. "FD 04/37 Brominated Flame Retardants and Brominated Dioxins in 2003 Total Diet Samples." *Central Science Laboratory*. Jun. 2005. 41 pages.

Jacobs et al. "Investigation of Selected Persistent Organic Pollutants in Famed Atlantic Salmon (*Salmo salar*), Salmon Aquaculture Feed, and Fish Oil Components of the Feed." *Eviron. Sci. Technol*. vol. 36. 2002. pp. 2797-2805.

Nisbet et al. "Toxic Equivalency Factors (TEFs) for polycyclic Aromatic Hydrocarbons (PAHs)." *Regulatory Toxicology & Pharmacology*. vol. 16. 1992. pp. 290-300.

Oetjen et al. "Levels of Toxaphene Indicator Compounds in Fish Meal, Fish Oil and Fish Feed." *Chemosphere*, vol. 37. No. 1. 1998. pp. 1-11.

*Primary Examiner* — Deborah D Carr
(74) *Attorney, Agent, or Firm* — Merchant & Gould P.C.

(57) ABSTRACT

Carrier fluid compositions and their use in processes for reducing the concentration of persistent organic pollutants, such as polychlorodibenzo-p-dioxins (PCDDs), polychlorodibenzo-p-furans (PCDDF), polychlorinated biphenyls (PCBs), polybrominated diphenyl ethers (PBDEs), polycyclic aromatic hydrocarbons (PAHs), and pesticides, such as chlorinated hydrocarbons, chlorinated toxaphenes and camphenes, in fish oil are disclosed. The process includes vacuum distillation of the fish oil in the presence of the carrier fluid compositions to provide a fish oil residue having a reduced concentration of persistent organic pollutants.

17 Claims, No Drawings

CARRIER FLUID COMPOSITION COMPRISING FATTY ACIDS ETHYL ESTERS AND PROCESS FOR REDUCING THE CONCENTRATION OF PERSISTENT ORGANIC POLLUTANTS IN FISH OIL

BACKGROUND

Fish oils are major sources of nutritionally valuable compounds, such as the polyunsaturated fatty acids ω-3 EPA and DHA. Nevertheless, many commercially available fish oils contain substantial amounts of pollutants, generally referred to as Persistent Organic Pollutants (POPs), which are organic chemical compounds that are lipophilic and environmentally persistent in that they accumulate through the food chain in fat tissue and oils of marine organisms, including marine mammals. The toxicity and biomagnification of POPs in the marine environment is well characterized.

According to the Stockholm Convention, POPs include organochlorinated pesticides such as Aldrin, Dieldrin, Chlordane, DDT, Endrin, Heptachlor, Mirex, Toxaphene, industrial chemicals such as polychlorinated biphenyls (PCBs), hexachlorobenzene (HCB), and dibenzodioxins and dibenzofurans which are by-products of several industrial chemical processes. In addition to POPs, there are other potentially toxic pollutants that persist in the environment but are not listed as POPs by the Stockholm Convention. These pollutants are referred to as Persistent Toxic Substances (PTSs) and include polycyclic aromatic hydrocarbons (PAHs), phthalate esters, polybrominated diphenyl ethers (PBDEs) used as flame retardants, polychlorinated naphthalenes (PCNs), bisphenol A (BPA), alkylphenols, and metals such as mercury, cadmium, lead, and arsenic. It is common for many crude and refined fish oils to contain dozens of pollutant organic compounds between the various types of POPs, PTSs, and their congeners.

In order to use fish oil as a source of EPA and DHA or for the production of EPA and DHA concentrates for nutraceutical and pharmaceutical purposes, it is necessary to reduce the levels of POPs and PTSs in the fish oil to at least the maximum levels permitted by existing regulations without altering the levels of nutritionally valuable compounds or affecting the oxidative stability of the oil. Processes for decreasing the levels of organic pollutants in fish oil have previously been disclosed. These processes include adsorption processes with activated carbon, steam stripping, and vacuum distillation with or without a carrier fluid. However, the amount and great variety of pollutants that may be present in the raw fish oil presents a significant challenge.

U.S. Pat. No. 6,469,187, for example, discloses a process to obtain marine oil with reduced amounts of polychlorinated dioxins, furans, biphenyls and polycyclic aromatic hydrocarbons by using activated carbon. Most marine oils, however, also contain many other types of pollutants, among them flame retardants (PBDEs) and chlorinated pesticides such as chlorinated hydrocarbons and chlorinated camphenes (toxaphenes), and the active carbon absorption type process disclosed in U.S. Pat. No. 6,469,187 is known to have little to practically no effect on reducing PBDEs.

Vacuum distillation processes for decreasing the amount of environmental pollutants are also known. This type of process typically includes adding a carrier fluid or volatile working fluid to the polluted oil and then subjecting the mixture to vacuum distillation. Numerous processes for the production of polyunsaturated fatty acid ethyl esters concentrates from fish oil are known, resulting in a variety of ethyl ester by-products or distilled fractions of different composition. EP 1523541 B1, for example, discloses a vacuum distillation process in which the carrier fluid is a fatty acid ethyl ester mixture generated as a by-product or distilled fraction from the production of polyunsaturated fatty acid ethyl ester concentrates from fish oil. The carrier fluid is the lighter fraction resulting from the distillation of fish oil transesterified with ethyl alcohol and includes C14 or C16 fatty acids and C18 fatty acids. This lighter fraction typically includes not more than 50% of unsaturated fatty acids esters.

Numerous processes for the production of polyunsaturated fatty acid ethyl esters concentrates from fish oil are known, resulting in a variety of ethyl ester by-products or distilled fractions of different composition. In addition, different compositions of fatty acid ethyl esters can be formulated from commercially available individual fatty acid esters or from ethyl esters prepared by using free fatty acids and ethylating said fatty acids. The formulation of ester mixtures from individual esters has the advantage of not being restricted to mixtures of compositions predetermined by the nature of the source oil.

Nevertheless, because fish oils may contain dozen of different pollutants, choosing an efficient carrier fluid for the removal of POPs through vacuum distillation of fish oils is challenging and complicated by (1) the variation in solubility and lipolificity of the several different POPs in the carrier fluid and (2) the broad spectrum of vapor pressures of those same components. For example, between PCBs congeners there is a vapor pressure variation of 8 orders of magnitude at room temperature (between $10^{-12}$ to $10^{-4}$ mmHg) and the selection of an efficient carrier fluid is further complicated because their vapor pressures and respective solubilities at higher temperatures, such as the operating temperatures of distillation columns, are unknown. Something similar happens with the others types of POPs and PTSs. Therefore, a carrier fluid composition that is suitable for use in vacuum distillation processes and capable of reducing the concentration of a wide variety of POPs and PTSs in fish oil to acceptable levels in an economically efficient process would be desirable.

SUMMARY

Carrier fluid compositions and their use in processes for reducing the concentration of persistent organic pollutants, such as polychlorodibenzo-p-dioxins (PCDDs), polychlorodibenzo-p-furans (PCDDF), polychlorinated biphenyls (PCBs), polybrominated diphenyl ethers (PBDEs), polycyclic aromatic hydrocarbons (PAHs), and pesticides, such as chlorinated hydrocarbons, chlorinated camphenes or toxaphenes in oils of marine origin, such as fish oils, are disclosed. The carrier fluid compositions include from 6 up to 24 esterified fatty acids. In embodiments, the carrier fluid compositions contain at least 75% by weight of unsaturated fatty acid esters. In embodiments, the carrier fluid compositions contain 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3).

The disclosed carrier fluid compositions can also be mixed with a polyunsaturated fatty acid, such as eicosapentaenoic acid, to enhance the efficiency of the carrier fluid composition in reducing the concentration of POPs in oils of marine origin.

In embodiments, the carrier fluid compositions comprise from 0.5 to 5% by weight of the polyunsaturated fatty acid.

A distillation process for reducing the concentration of POPs in an oil of marine origin using the carrier fluid compositions is also disclosed. The distillation process generally includes contacting an oil of marine origin, such as a fish oil, with a carrier fluid composition of the disclosure to form a mixture; feeding the mixture into a distillation column, such as a short-path distillation column, to generate a distillate that includes the POPs; and collecting the residue comprising the oil having a reduced concentration of POPs. The evaporator temperature of the distillation column can be between 150° C. and 280° C. and the column pressure can be between 0.0001 mbar and 0.5 mbar to generate the distillate and the residue. In embodiments, the mixture being fed into the distillation column comprises from about 1 to about 10% by weight of a carrier fluid composition of the disclosure.

DETAILED DESCRIPTION OF THE INVENTION

I. Definitions

The term Persistent Organic Pollutants or POPs as used herein comprises compounds included in the Stockholm Convention as well as PTSs. The POPs may be divided into two major groups: Polycyclic aromatic hydrocarbons or PAHs and Halogenated compounds. These latter comprise:

- Dioxins or polychlorinated dibenzo-p-dioxins (PCDDs), with 75 congeners, out of which 7 are toxic, the more toxic is 2,3,7,8-tetrachlorodibenzo-p-dioxin or 2,3,7,8 TCDD.
- Polychlorinated dibenzo-p-furans (PCDDF), with 135 congeners, out of which 10 are toxic.
- Polychlorinated biphenyls (PBCs), with 209 congeners, out of which 12 have a coplanar structure and are mono-ortho or non-ortho-substituted. These 12 exhibit toxicity and they are referred to as dioxin-like PCBs compounds.
- Polybrominated diphenyl ethers (PBDEs), there are three major types of them, penta-, octa-, and deca-PBDEs (although the penta- group is a four to six bromine atoms PBDEs mixture and the octa-PBDE group was banned in the European Union in 2004, it is expected that levels of these substances will gradually disappear from the environment). There may be as many as 209 congeners. The congeners BDE-28, -47, -99, -100, -153, -154, -183 and -209 were of primary interest to EFSA (The European Food Safety Authority) Panel on Contaminants in the Food Chain, the greater dietary exposure is for BDE-47 and -209. The risk evaluation was only carried out with PBDE-99; it was found a Tolerable Diary Intake of 2.3 pg/kg body weight per day.
- Perfluorinated compounds (PFAs).
- Pesticides such as, DDT, chlordane, aldrin, dieldrin, endrin, heptachlor, mirex, toxaphenes, hexachlorobenzene.

Usually, fish oils do not have only one congener but include mixtures of different amounts of PCDFs/PCDDs, PBDEs and PCBs congeners, each one with different toxicological properties. In these cases, the mere knowledge of the total concentration of each isomer does not give much quantitative information about the toxicological characteristics of the whole sample. Detailed toxicological data is available for only of a few congeners, 2,3,7,8-TCDD being the most studied.

For these reasons, the so-called Toxic Equivalency Factors (TEFs) were introduced in order to measure the toxicity of PCDFs/PCDDs, PCBs and PBDEs mixtures and are expressed in terms of equivalent amounts of 2,3,7,8-TCDD. The use of these factors presupposes that the toxicity is additive, thus total toxicity of the mixture is equal to the sum of the individual toxicity of each isomer and congener in the mixture. For assessing the individual toxicity, each isomer is given a weighting factor relative to 2,3,7,8-TCDD, which is given a TEF value of 1. Using this weighting factor, the toxic equivalent value (TEQ) of each isomer is calculated and represents the amount of 2,3,7,8-TCDD that produces the same toxic effects as the isomer. The sum of all TEQs provides the 2,3,7,8-TCDD total amount (total TEQ), which is toxicologically equivalent to the mixture under study.

There are different Toxic Equivalency Factors proposed for some organizations and the difference in these factors relies in the weighting system for each isomer or congener. The most commonly used is called International Toxic Equivalency Factor (1-TEF). In addition, there is a specific factor for food products with regard to dioxins and dioxin-like PCBs (Commission of the European Communities, Council Regulation (EC) N° 199/2006) shown in Table 1. The convenience to express the results in TEQs is that a numerical value can express the toxicity degree of a PCDFs/PCDD, PCBs complex mixture allowing for a comparative base between different samples.

TABLE 1

International Toxic Equivalency Factor

| Congeners | TEF Value |
|---|---|
| Dibenzo-p-dioxins (PCDD) | |
| 2,3,7,8-TCDD | 1 |
| 1,2,3,7,8-PeCDD | 1 |
| 1,2,3,4,7,8-HxCDD | 0.1 |
| 1,2,3,6,7,8-HxCDD | 0.1 |
| 1,2,3,7,8,9-HxCDD | 0.1 |
| 1,2,3,4,6,7,8-HpCDD | 0.01 |
| OCDD | 0.0001 |
| Dibenzofurans (PCDF) | |
| 2,3,7,8-TCDF | 0.1 |
| 1,2,3,7,8-PeCDF | 0.05 |
| 2,3,4,7,8-PeCDF | 0.5 |
| 1,2,3,4,7,8-HxCDF | 0.1 |
| 1,2,3,6,7,8-HxCDF | 0.1 |
| 1,2,3,7,8,9-HxCDF | 0.1 |
| 2,3,4,6,7,8-HxCDF | 0.1 |
| 1,2,3,4,6,7,8-HpCDF | 0.01 |
| 1,2,3,4,7,8,9-HpCDF | 0.01 |
| OCDF | 0.0001 |
| "dioxin-like" PCB | |
| non-ortho + mono-ortho PCB | |
| non-ortho PCB | |
| PCB 77 | 0.0001 |
| PCB 81 | 0.0001 |
| PCB 126 | 0.1 |
| PCB 169 | 0.01 |
| mono-ortho PCB | |
| PCB 105 | 0.0001 |
| PCB 114 | 0.0005 |
| PCB 118 | 0.0001 |
| PCB 123 | 0.0001 |
| PCB 156 | 0.0005 |
| PCB 157 | 0.0005 |
| PCB 167 | 0.00001 |
| PCB 189 | 0.0001 |

Abbreviations: "T" = tetra; "Pe" = penta; "Hx" = hexa; "Hp" = hepta; "O" = octa; "CDD" = chlorodibenzodioxin; "CDF" = chlorodibenzofuran; "CB" = chlorobiphenyl According to the regulations ((EC) N° 199/2006) the maximum level of dioxins [the sum of poly-chlorodibenzo-p-dioxins (PCDD) and poly-chlorodibenzofurans (PCDF)

expressed as toxic equivalents set by the World Health Organization (WHO-TEQs) using toxic equivalency factor (WHO-TEF, 1997)], for fish oil is 2 ng/kg and the maximum level for the sum of dioxins and "dioxin-like" PCBs is 10 ng/kg. For the Council for Responsible Nutrition (CRN) the maximum level for fish oils is 2 pg/g WHO-TEQ (2 ng/kg), the PBCs maximum level is expressed by weight and should include the 52, 101, 118, 138, 153 y 180 congeners, and it is 0.09 mg/kg; and "dioxin-like" PCBs maximum level is 3 pg/g WHO-TEQ (dioxins and furans sum is still 2 pg/g). CRN recommends for lead, cadmium, mercury and inorganic arsenic values less than 0.1 mg/kg.

The maximum limits for chlorinated pesticides in fish oils range from 0.1 ppm for hexachlorobenzene to 2 ppb for Aldrin (FAO/WHO). Regarding toxaphenes or chlorinated camphenes, the Annex to the Directive 2002/32 EC establishes for all types of food products a maximum level of 0.1 mg/kg (based on 12% water content).

Benzo(a)pyrene (BaP) is the most carcinogenic and studied form of PAH, its maximum level according to EU standards ((EC) N° 208/2005) should not exceed 2 μg/kg in fat and oils for human consumption, while the sum of benzo(a) pyrene, benzo(a)anthracene, benzo(a)fluoranthene and chrysene should not exceed 10 μg/kg in the same products. Several approaches have been proposed to establish Toxic Equivalency Factors for PAHs in relation to the most toxic of them, the Nisbet-LaGoy factor being used most frequently by those of skill in the art.

As used herein, the term "fish oil" means an oil of marine origin including fish oil, fish viscera oil, and oils obtained from marine mammals.

II. Modes for Carrying Out the Invention

Carrier fluid compositions and processes for their use in the preparation of an oil of marine origin, such as fish oil or fish viscera oil, with reduced content of pollutants, including but not limited to polychlorodibenzo-p-dioxins (PCDDs), polychlorodibenzo-p-furans (PCDDF), polychlorinated biphenyls (PCBs), polybrominated diphenyl ethers (PBDEs), polycyclic aromatic hydrocarbons (PAHs) and pesticides, such as chlorinated hydrocarbons, chlorinated camphenes, (toxaphenes), are disclosed.

It has unexpectedly been found that there are significant differences between fatty acid ethyl esters of different carrier fluid compositions in the efficiency of the reduction of fish oil pollutant concentration. A carrier fluid is considered to be more efficient compared to another carrier fluid if, under the same operating conditions, it leads to a significantly greater reduction of POPs concentration in the oil. The nature and composition of ethyl esters used as carrier fluids for reducing the concentration of POPs in fish oils significantly influences the level of reduction of POPs in the fish oils. It has been found that a carrier fluid comprising from 6 to 24 ethyl esters of specific fatty acids, with an unsaturated fatty acid ethyl ester content of at least 75% by weight, is significantly more efficient in reducing the concentration of POPs in fish oil compared to conventional carrier fluid compositions, such as the carrier fluid disclosed in EP 1523541 B1 consisting of ethyl ester mixtures originated as by-products (distillate fractions) from a regular process for the production of EPA and DHA ethyl ester concentrates, having an unsaturated fatty acid ethyl esters content of 50% by weight or less.

In one aspect, the carrier fluid composition (CF1) comprises from 6 up to 24 fatty acids ethyl esters with an unsaturated fatty acid ethyl ester content of at least 75% by weight. Under the same distillation operating conditions, CF1 reduces the concentration of a series of POPs, including dioxins, furans, pesticides such as chlorinated hydrocarbons and chlorinated camphenes (toxaphenes), PCBs, PBDEs and PAHs, to a significantly greater extent that conventional carrier fluids, such as the carrier fluid disclosed in EP 1523541 B1 consisting of ethyl ester mixtures originated as by-products (distillate fractions) from a regular process for the production of EPA and DHA ethyl ester concentrates. The carrier fluid CF1 comprises at least a fatty acid ethyl ester wherein the fatty acid moiety is a C20 or C22 fatty acid.

Embodiments of carrier fluid composition CF1 are shown in Table 2. CF1 generally includes from 6 up to 24 esterified fatty acids and can additionally include the composition and concentration ranges in weight % relative to the mixture shown in Table 2. Preferably, carrier fluid CF1 comprises at least 75% by weight of unsaturated fatty acid esters.

TABLE 2

| CF1 Components* | Concentration range (% by weight) |
|---|---|
| Tetradecanoic Acid Ethyl Ester (Myristic Acid C14:0) | 0-20 |
| Palmitic Acid Ethyl Ester (C16:0) | 0-15 |
| Palmitoleic Acid Ethyl Ester (C16:1) | 0-40 |
| Stearic Acid Ethyl Ester (C18:0) | 0-5 |
| Oleic Acid Ethyl Ester (C18:1) | 0-30 |
| Linoleic Acid Ethyl Ester (C18:2n6) | 0-10 |
| α-Linolenic Acid Ethyl Ester (C18:3n3) | 0-5 |
| γ-Linolenic Acid Ethyl Ester (C18:3n6) | 0-5 |
| Stearidonic Acid Ethyl Ester (Acid Moroctic C18:4n3) | 0-15 |
| Eicosanoic Acid Ethyl Ester (Arachidic Acid (C20:0)) | 0-15 |
| Eicosenoic Acid Ethyl Ester (Gondoic Acid (C20:1n9)) | 0.1-10 |
| Eicosadienoic Acid Ethyl Ester (C20:2n6) | 0.1-20 |
| Eicosatrienoic Acid Ethyl Ester (C20:3n3) | 0.1-20 |
| Eicosatrienoic Acid Ethyl Ester or Dihomo-γ-Linolenic Acid (C20:3n6) | 0.1-20 |
| Eicosatetraenoic Acid Ethyl Ester or Araquidonic Acid (C20:4n6) | 0-20 |
| Eicosapentaenoic Acid Ethyl Ester (C20:5n3) | 0.1-80 |
| Docosanoic Acid Ethyl Ester (Behenic Acid C22:0) | 0-5 |
| Cetoleic Acid Ethyl Ester (C22:1n11) | 0-10 |
| Erucic Acid Ethyl Ester (C22:1n9) | 0-20 |
| Docosadienoic Acid Ethyl Ester (C22:2 Cis 13,16) | 0-20 |
| Docosapentaenoic Acid Ethyl Ester (C22:5n3) | 0-30 |
| Docosahexaenoic Acid Ethyl Ester (C22:6n3) | 0.1-80 |
| Tetracosanoic Acid Ethyl Ester (Lignoceric Acid C24:0) | 0-5 |
| Tetracosaenoic Acid Ethyl Ester (Nervonic Acid C24:1) | 0-5 |

*The esterified fatty acid carbon number and double bond numbers are shown in the parentheses. In some instances, the fatty acid common name is provided.

In an embodiment, carrier fluid composition CF1 comprises 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3).

In another embodiment, carrier fluid composition CF1 comprises 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3) and at least one of the following fatty acid ethyl esters:

| Fatty acid ethyl ester | Composition CF1 maximum concentration (% by weight) |
|---|---|
| Tetradecanoic Acid Ethyl Ester (Myristic Acid C14:0) | 20 |
| Palmitic Acid Ethyl Ester (C16.0) | 15 |
| Palmitoleic Acid Ethyl Ester (C16:1) | 40 |
| Stearic Acid Ethyl Ester (C18:0) | 5 |
| Oleic Acid Ethyl Ester (C18.1) | 30 |
| Linoleic Acid Ethyl Ester (C18:2n6) | 10 |
| α-Linolenic Acid Ethyl Ester (C18:3n3) | 5 |
| γ-Linolenic Acid Ethyl Ester (C18:3n6) | 5 |
| Stearidonic Acid Ethyl Ester (Acid Moroctic C18:4n3) | 15 |
| Eicosanoic Acid Ethyl Ester (Arachidic Acid (C20:0)) | 15 |
| Eicosatetraenoic Acid Ethyl Ester or Araquidonic Acid (C20:4n6) | 20 |
| Docosanoic Acid Ethyl Ester (Behenic Acid C22:0) | 5 |
| Cetoleic Acid Ethyl Ester (C22:1n11) | 10 |
| Erucic Acid Ethyl Ester (C22:1n9) | 20 |
| Docosadienoic Acid Ethyl Ester (C22:2 Cis 13,16) | 20 |
| Docosapentaenoic Acid Ethyl Ester (C22:5n3) | 30 |
| Tetracosanoic Acid Ethyl Ester (Lignoceric Acid C24:0) | 5 |
| Tetracosaenoic Acid Ethyl Ester (Nervonic Acid C24:1) | 5 |

wherein at least 75% weight of the composition CF1 comprises unsaturated fatty acid ethyl esters.

In yet another embodiment, carrier fluid composition CF1 comprises 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3) and at least one of the following fatty acid ethyl esters:

| Fatty acid ethyl ester | Composition CF1 concentration range (% by weight) |
|---|---|
| Tetradecanoic Acid Ethyl Ester (Myristic Acid C14:0) | 0.1-20 |
| Palmitic Acid Ethyl Ester (C16.0) | 0.1-15 |
| Palmitoleic Acid Ethyl Ester (C16:1) | 0.1-40 |
| Stearic Acid Ethyl Ester (C18:0) | 0.1-5 |
| Oleic Acid Ethyl Ester (C18.1) | 0.1-30 |
| Linoleic Acid Ethyl Ester (C18:2n6) | 0.1-10 |
| α-Linolenic Acid Ethyl Ester (C18:3n3) | 0.1-5 |
| γ-Linolenic Acid Ethyl Ester (C18:3n6) | 0.1-5 |
| Stearidonic Acid Ethyl Ester (Acid Moroctic C18:4n3) | 0.1-15 |
| Eicosanoic Acid Ethyl Ester (Arachidic Acid (C20:0)) | 0.1-15 |
| Eicosatetraenoic Acid Ethyl Ester or Araquidonic Acid (C20:4n6) | 0.1-20 |
| Docosanoic Acid Ethyl Ester (Behenic Acid C22:0) | 0.1-5 |
| Cetoleic Acid Ethyl Ester (C22:1n11) | 0.1-10 |
| Erucic Acid Ethyl Ester (C22:1n9) | 0.1-20 |
| Docosadienoic Acid Ethyl Ester (C22:2 Cis 13,16) | 0.1-20 |
| Docosapentaenoic Acid Ethyl Ester (C22:5n3) | 0.1-30 |
| Tetracosanoic Acid Ethyl Ester (Lignoceric Acid C24:0) | 0.1-5 |

-continued

| Fatty acid ethyl ester | Composition CF1 concentration range (% by weight) |
|---|---|
| Tetracosaenoic Acid Ethyl Ester (Nervonic Acid C24:1) | 0.1-5 |

wherein at least 75% weight of the composition CF1 comprises unsaturated fatty acid ethyl esters.

In yet another embodiment, carrier fluid composition CF1 comprises 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3) and the following fatty acid ethyl esters:

| Fatty acid ethyl ester | Composition CF1 concentration range (% by weight) |
|---|---|
| Stearic Acid Ethyl Ester (C18:0) | 0.1-5 |
| Oleic Acid Ethyl Ester (C18.1) | 0.1-30 |
| Linoleic Acid Ethyl Ester (C18:2n6) | 0.1-10 |
| α-Linolenic Acid Ethyl Ester (C18:3n3) | 0.1-5 |
| γ-Linolenic Acid Ethyl Ester (C18:3n6) | 0.1-5 |
| Stearidonic Acid Ethyl Ester (Acid Moroctic C18:4n3) | 0.1-15 |
| Eicosanoic Acid Ethyl Ester (Arachidic Acid (C20:0)) | 0.1-15 |
| Eicosatetraenoic Acid Ethyl Ester or Araquidonic Acid (C20:4n6) | 0.1-20 |
| Docosanoic Acid Ethyl Ester (Behenic Acid C22:0) | 0.1-5 |
| Cetoleic Acid Ethyl Ester (C22:1n11) | 0.1-10 |
| Erucic Acid Ethyl Ester (C22:1n9) | 0.1-20 |
| Docosadienoic Acid Ethyl Ester (C22:2 Cis 13,16) | 0.1-20 |
| Docosapentaenoic Acid Ethyl Ester (C22:5n3) | 0.1-30 |
| Tetracosanoic Acid Ethyl Ester (Lignoceric Acid C24:0) | 0.1-5 |
| Tetracosaenoic Acid Ethyl Ester (Nervonic Acid C24:1) | 0.1-5 |

wherein at least 75% weight of the composition CF1 comprises unsaturated fatty acid ethyl esters.

In yet another embodiment, carrier fluid composition CF1 comprises 0.1 to 10% by weight of Eicosenoic Acid Ethyl Ester (Gondoic Acid (C20:1n9)), 0.1 to 20% by weight of Eicosadienoic Acid Ethyl Ester (C20:2n6), 0.1 to 20% by weight of Eicosatrienoic Acid Ethyl Ester (C20:3n3), 0.1 to 20% by weight of Eicosatrienoic Acid Ethyl Ester or Dihomo-γ-Linolenic Acid (C20:3n6), 0.1 to 80% by weight of Eicosapentaenoic Acid Ethyl Ester (C20:5n3), and 0.1 to 80% by weight of Docosahexaenoic Acid Ethyl Ester (C22:6n3) and the following fatty acid ethyl esters:

| Fatty acid ethyl ester | Composition CF1 concentration range (% by weight) |
|---|---|
| Tetradecanoic Acid Ethyl Ester (Myristic Acid C14:0) | 0.1-20 |

-continued

| Fatty acid ethyl ester | Composition CF1 concentration range (% by weight) |
|---|---|
| Palmitic Acid Ethyl Ester (C16.0) | 0.1-15 |
| Palmitoleic Acid Ethyl Ester (C16:1) | 0.1-40 |
| Stearic Acid Ethyl Ester (C18:0) | 0.1-5 |
| Oleic Acid Ethyl Ester (C18.1) | 0.1-30 |
| Linoleic Acid Ethyl Ester (C18:2n6) | 0.1-10 |
| α-Linolenic Acid Ethyl Ester (C18:3n3) | 0.1-5 |
| γ-Linolenic Acid Ethyl Ester (C18:3n6) | 0.1-5 |
| Stearidonic Acid Ethyl Ester (Acid Moroctic C18:4n3) | 0.1-15 |
| Eicosanoic Acid Ethyl Ester (Arachidic Acid (C20:0)) | 0.1-15 |
| Eicosatetraenoic Acid Ethyl Ester or Araquidonic Acid (C20:4n6) | 0.1-20 |
| Docosanoic Acid Ethyl Ester (Behenic Acid C22:0) | 0.1-5 |
| Docosadienoic Acid Ethyl Ester (C22:2 Cis 13,16) | 0.1-20 |
| Docosapentaenoic Acid Ethyl Ester (C22:5n3) | 0.1-30 |

wherein at least 75% weight of the composition CF1 comprises unsaturated fatty acid ethyl esters.

In a second aspect, it has been found that mixing the carrier fluid composition CF1 with a polyunsaturated fatty acid, such as eicosapentaenoic acid, results in a carrier fluid composition CF2 which, under the same distillation operating conditions as CF1, enhances the efficiency of the carrier fluid composition in vacuum distillation processes reducing the concentration of POPs in the fish oil being processed to a significantly greater extent than carrier fluid composition CF1. Carrier fluid composition CF2 preferably comprises at least 75% by weight of unsaturated fatty acid ethyl esters. In an embodiment, carrier fluid composition CF2 comprises from 0.5 to 5% by weight of the polyunsaturated fatty acid. In an embodiment, the polyunsaturated fatty acid is eicosapentaenoic acid. In an embodiment, CF2 is formed by contacting CF1 with eicosapentaenoic acid to form a mixture (CF2) comprising 0.5 to 5% by weight of eicosapentaenoic acid.

In addition to reducing the concentration of POPs and PTSs in fish oils, it has also been unexpectedly found that carrier fluid compositions CF1 and CF2 remove a significant fraction of the free cholesterol present in the fish oils, and surprisingly also removes a relevant fraction of esterified cholesterol in the fish oils.

The carrier fluid compositions disclosed herein can be used in distillation processes, such as vacuum distillation processes, for reducing the concentration of POPs and/or PSTs in marine oils, such as fish oil or fish viscera oil. Such a process generally includes contacting fish oil or fish viscera oil with a carrier fluid composition disclosed herein to form a mixture and feeding the mixture into a vacuum distillation column, such as a short-path distillation column. The short-path distillation column is also known as a molecular distillation column when the distance between the evaporator and the condenser is comparable to the mean free path of the distillate molecules under the operating conditions. The proportion of carrier fluid composition relative to mixture can be from 1 to 10%, preferably from 2 to 8%. The mixture is fed into the vacuum distillation column, generally at a rate from 1 to 150 kg/h per m2 of evaporating surface, preferably between 10 to 100 kg/h per m2.

The vacuum distillation process generally includes an internal condenser next to the evaporating surface where the condenser temperature is higher than the melting point of the carrier fluid. In an embodiment, the evaporator temperature is between 150° C. and 280° C., preferably between 180° C. and 240° C. In an embodiment, the column pressure is between 0.0001 mbar and 0.5 mbar, preferably between 0.001 and 0.05 mbar. In an embodiment, the evaporator temperature is between 150° C. and 280° C., preferably between 180° C. and 240° C., and the column pressure is between 0.0001 mbar and 0.5 mbar, preferably between 0.001 and 0.05 mbar. The distillation process results in the separation of a distillate that includes the carrier fluid and pollutants. The distillate condenses at the internal condenser, and a residue comprising the oil of marine origin with a decreased pollutants concentration is provided. The distillate and the residue leave the column separately and are collected at the column exit.

In vacuum distillation processes, the carrier fluid compositions disclosed herein have been found to be surprisingly more efficient for decreasing concentrations of different types of POPs compared to conventional carrier fluids, such as the carrier fluid disclosed in EP 1523541 B1 consisting of ethyl ester mixtures originated as by-products (distillate fractions) from a regular process for the production of EPA and DHA ethyl ester concentrates. As shown in the Examples, the differences in efficiency of the carrier fluid compositions of the disclosure compared to a conventional carrier fluid range from about 30% to an order of magnitude greater reduction of different types of POPs concentrations. Interestingly, in some instances conventional carrier fluids have been found to have the opposite effect and can generate increased concentrations of some pollutants. See, for example, Tables 5 and 6 in EP 1523541 B1. The increase in the concentration of some pollutants could be due to the presence of undetectable trace levels of the compound in the raw material that are concentrated during the distillation process to a detectable level. However, such effects have not been observed using the carrier fluids of the disclosure.

EXAMPLES

Although, certain embodiments of the invention have been described, other embodiments may exist. Many aspects, embodiments, modifications and equivalents to the invention, after reading the description herein, may be suggested to those skilled in then art without departing from the spirit of the invention or the scope of the object of the invention.

In the following examples, composition M1 is an embodiment of carrier fluid composition CF1 as shown in Table 2. M1 contains 21 fatty acid ethyl esters containing 96.3% of unsaturated fatty acid esters, mostly polyunsaturated. Composition M2 is an embodiment of carrier fluid composition CF2. M2 contains 21 fatty acids ethyl esters and 5% by weight of eicosapentaenoic acid containing 96.5% of unsaturated fatty acid esters, mostly polyunsaturated. The efficiency of M1 and M2 in removing POPs/reducing the concentration of POPs from fish oil are compared to a conventional carrier fluid exemplified in the Examples by composition M, which corresponds to an embodiment of the carrier fluid disclosed in EP 1523541 B1 consisting of ethyl ester mixtures originated as by-products (distillate fractions) from a regular process for the production of EPA and DHA ethyl ester concentrates. Composition M contains 17 fatty acids ethyl esters, containing 42.7% by weight of unsaturated fatty acid esters.

Compositions M, M1 and M2 shown below in Table 3 were used in Examples 1-5 and formulated with fatty acid ethyl esters obtained from different suppliers.

TABLE 3

| Component | M (% by weight) | M1 (% by weight) | M2 (% by weight) |
|---|---|---|---|
| Tetradecanoic Acid Ethyl Ester (Myristic Acid C14:0) | 19.0 | 0.0 | 0.0 |
| Palmitic Acid Ethyl Ester (C16.0) | 35.5 | 0.0 | 0.0 |
| Palmitoleic Acid Ethyl Ester (C16:1) | 20.6 | 0.0 | 0.0 |
| Stearic Acid Ethyl Ester (C18:0) | 2.3 | 1.0 | 0.9 |
| Oleic Acid Ethyl Ester (C18.1) | 13.1 | 5.0 | 4.7 |
| Linoleic Acid Ethyl Ester (C18:2n6) | 1.1 | 2.0 | 1.9 |
| α-Linolenic Acid Ethyl Ester (C18:3n3) | 0.2 | 1.0 | 0.9 |
| γ-Linolenic Acid Ethyl Ester (C18:3n6) | 0.8 | 0.1 | 0.1 |
| Stearidonic Acid Ethyl Ester (Acid Moroctic C18:4n3) | 2.2 | 5.0 | 4.7 |
| Eicosanoic Acid Ethyl Ester (Arachidic Acid (C20:0)) | 0.1 | 2.0 | 1.9 |
| Eicosenoic Acid Ethyl Ester (Gondoic Acid (C20:1n9)) | 0.0 | 3.0 | 2.8 |
| Eicosadienoic Acid Ethyl Ester (C20:2n6) | 0.1 | 2.0 | 1.9 |
| Eicosatrienoic Acid Ethyl Ester (C20:3n3) | 0.1 | 1.0 | 0.9 |
| Eicosatrienoic Acid Ethyl Ester or Dihomo-γ-Linolenic Acid (C20:3n6) | 0.1 | 1.0 | 0.9 |
| Eicosatetraenoic Acid Ethyl Ester or Araquidonic Acid (C20:4n6) | 0.1 | 2.0 | 1.9 |
| Eicosapentaenoic Acid Ethyl Ester (C20:5n3) | 3.9 | 43.0 | 40.8 |
| Docosanoic Acid Ethyl Ester (Behenic Acid C22:0) | 0.0 | 0.5 | 0.5 |
| Cetoleic Acid Ethyl Ester (C22:1n11) | 0.0 | 0.1 | 0.1 |
| Erucic Acid Ethyl Ester (C22:1n9) | 0.0 | 3.0 | 2.8 |
| Docosadienoic Acid Ethyl Ester (C22:2 Cis 13,16) | 0.0 | 2.0 | 1.9 |
| Docosapentaenoic Acid Ethyl Ester (C22:5n3) | 0.0 | 5.0 | 4.7 |
| Docosahexaenoic Acid Ethyl Ester (C22:6n3) | 0.2 | 21.0 | 19.9 |
| Tetracosanoic Acid Ethyl Ester (Lignoceric Acid C24:0) | 0.0 | 0.1 | 0.1 |
| Tetracosaenoic Acid Ethyl Ester (Nervonic Acid C24:1) | 0.2 | 0.1 | 0.1 |
| Eicosapentaenoic Acid | 0.0 | 0.0 | 5.0 |

In the Examples, samples were analyzed using well known techniques according to the references listed below:

Analyses for dioxins, furans, and PCBs were performed as described in the publication "Dioxins and polychlorinated biphenyls in fish oil dietary supplements and licensed medicines", Food Surveillance Information Sheet, Vol. 106, June 1997, MAFF, London, and the references cited therein.

Analyses for HBC, HCHs, DDTs were performed as described in the publication "Environ. Sci. Technol", 2002, 36:2797-2805, by Jacobs et al.

PBDEs analyses were performed as described in the UKAS (United Kingdom Accreditation Service) Report N° FD 04/37 entitled: "Brominated Flame Retardants and Brominated Dioxins in 2003 Total Diet Samples".

The concentration of PHAs was determined by capillary gas chromatography-mass spectrometry and quantified by reference to $^{13}C$ internal standards. The results are given in μg/kg for individual compounds and, also as benzo-(a)-pyrene (BaP) equivalents.

The toxaphenes analyses were performed as described in the publication "Levels of toxaphene indicator compounds in fish meal, fish oil and fish feed", Chemosphere, 1998, 37:1-11, by Oetjen, K. and Karl, H.

Cholesterol analyses were performed according to AOAC Official Method 994.1 Free cholesterol determination was made on non-saponified samples.

Example 1

Example 1 shows the reduction of the concentration of dioxins and furans in sardine oil by means of distillation with different carrier fluids.

Sardine oil containing different dioxins and furans (see Table 4) was mixed with composition M, M1, or M2 as the carrier fluid at a weight ratio 7:100 of the carrier fluid: sardine oil. The mixture was fed to a stainless steel short path distillation column model VK-83-6 (VTA GmbH) at a flow rate of 30 kg/h/m2 and distilled at a temperature of 205° C. and a pressure of 0.004 mbar, obtaining an oil residue containing dioxins and furans at the concentrations shown in Table 4.

TABLE 4

Dioxins and furans content in sardine oil, before and after distillation with different carrier fluid compositions.

| | Concentration before distillation (ng/kg) | Concentration after distillation with M (ng/kg) | Concentration after distillation with M1 (ng/kg) | Concentration after distillation with M2 (ng/kg) |
|---|---|---|---|---|
| Dioxins | | | | |
| 2,3,7,8-TCDD | 1.54 | 0.12 | 0.08 | 0.06 |
| 1,2,3,7,8-PeCDD | 0.84 | 0.10 | 0.07 | <0.05 |
| 1,2,3,4,7,8-HxCDD | 1.40 | 0.40 | 0.14 | <0.07 |
| 1,2,3,6,7,8-HxCDD | 2.35 | 0.20 | 0.11 | <0.07 |
| 1,2,3,7,8,9-HxCDD | 0.80 | 0.16 | 0.12 | <0.08 |
| 1,2,3,4,6,7,8-HpCDD | 2.03 | 0.46 | 0.27 | 0.10 |
| OCDD | 3.25 | 2.1 | 1.7 | 1.3 |
| TEQ ng/kg | 2.86 | 0.30 | 0.19 | 0.13 |
| Furans | | | | |
| 2,3,7,8-TCDF | 17.3 | 1.2 | 0.7 | 0.12 |
| 1,2,3,7,8-PeCDF | 6.20 | 0.25 | 0.14 | 0.09 |
| 2,3,4,7,8-PeCDF | 4.85 | 0.19 | 0.12 | 0.07 |
| 1,2,3,4,7,8-HxCDF | 14.8 | 2.2 | 1.5 | 0.10 |
| 1,2,3,6,7,8-HxCDF | 0.30 | 0.18 | 0.12 | 0.07 |
| 1,2,3,7,8,9-HxCDF | 2.64 | 0.96 | 0.41 | <0.07 |
| 2,3,4,6,7,8-HxCDF | 3.26 | 0.86 | 0.23 | 0.12 |
| 1,2,3,4,6,7,8-HpCDF | 1.07 | 0.67 | 0.28 | 0.11 |
| 1,2,3,4,7,8,9-HpCDF | 0.36 | <0.17 | <0.17 | <0.17 |
| OCDF | 6.57 | 1.23 | 0.97 | 0.84 |
| TEQ ng/kg | 6.58 | 0.66 | 0.37 | 0.09 |

Distillations utilizing composition M, M1 or M2 as the carrier fluid were replicated three additional times for each composition under the conditions of Example 1. The mean and the standard deviation (n=4) for each of compositions M, M1, and M2 are shown in Table 5.

TABLE 5

Dioxins and furans content in sardine oil, before and after distillation (n = 4) with different carrier fluid compositions. The values after distillation are expressed as the mean and standard deviation (n = 4).

| Pollutant | Concentration before distillation | Concentration after distillation with M carrier fluid | Concentration after distillation with M1 carrier fluid | Concentration after distillation with M2 carrier fluid |
|---|---|---|---|---|
| Dioxins TEQ ng/kg | 2.86 | 0.2725 ± 0.0574 | 0.1975 ± 0.0359 | 0.1125 ± 0.0350 |
| Furans TEQ ng/kg | 6.58 | 0.6150 ± 0.0342 | 0.3525 ± 0.0263 | 0.1300 ± 0.0271 |

Additionally, the content of free and esterified cholesterol in the sardine oil before and after distillation with M, M1, or M2 was determined. The results are shown in Table 6.

TABLE 6

Content of free and esterified cholesterol in sardine oil samples

| Cholesterol type | Concentration before distillation mg/g | Concentration after distillation with M mg/g | Concentration after distillation with M1 mg/g | Concentration after distillation with M2 mg/g |
|---|---|---|---|---|
| Free Cholesterol | 7.5 | 3.5 | 2.3 | 2.1 |
| Esterified Cholesterol | 2.5 | 2.4 | 2.2 | 2.1 |

Example 2

Example 2 shows a reduction in the concentration of polychlorinated biphenyls (PCBs) and polybrominated diphenyl ethers (PBDEs) in horse mackerel oil, by means of distillation with carrier fluids M1 and M2.

Horse mackerel oil containing different PCB congeners (see Table 7) was mixed with composition M, M1, or M2 as the carrier fluid at a weight ratio 7:100 of carrier fluid:

horse mackerel oil. The mixture was fed to a stainless steel short path distillation column model VK-83-6 (VTA GmbH) at a flow rate of 35 kg/h/m2 and distilled at a temperature of 185° C. and a pressure of 0.002 mbar, obtaining a distillated oil residue containing PCBs at concentrations listed in Table 7.

TABLE 7

PCBs content in horse mackerel oil before and after distillation with different carrier fluid compositions.

| Pollutant | Concentration before distillation µg/kg | Concentration after distillation with M, µg/kg | Concentration after distillation with M1, µg/kg | Concentration after distillation with M2, µg/kg |
|---|---|---|---|---|
| PCB 77* | 0.76 | 0.072 | 0.012 | 0.003 |
| PCB 81* | 0.23 | 0.009 | 0.005 | 0.001 |
| PCB 101 | 16.90 | 4.800 | 0.860 | 0.095 |
| PCB 118* | 27.30 | 6.80 | 1.40 | 0.17 |
| PCB 123* | 2.20 | 0.80 | 0.10 | 0.07 |
| PCB 126* | 0.48 | 0.12 | 0.07 | 0.008 |
| PCB 138 | 19.80 | 2.80 | 0.17 | 0.02 |

TABLE 7-continued

PCBs content in horse mackerel oil before and after distillation with different carrier fluid compositions.

| Pollutant | Concentration before distillation µg/kg | Concentration after distillation with M, µg/kg | Concentration after distillation with M1, µg/kg | Concentration after distillation with M2, µg/kg |
|---|---|---|---|---|
| PCB 153 | 41.40 | 5.80 | 1.70 | 0.23 |
| PCB 167* | 3.20 | 0.94 | 0.18 | 0.07 |
| PCB 169* | 2.80 | 0.86 | 0.32 | 0.014 |
| PCB 180 | 14.70 | 3.40 | 0.98 | 0.04 |
| PCB 189* | 0.98 | 0.32 | 0.07 | 0.01 |
| Total PCBs | 130.75 | 26.72 | 5.87 | 0.73 |
| Total PCBs TEQ µg/kg | 0.079 | 0.021 | 0.010 | 0.001 |

* PCBs congeners with toxic equivalency factor assigned.

TABLE 8

PBDEs content in horse mackerel oil before and after distillation with different carrier fluid compositions (continuation)

| Pollutant | Concentration before distillation µg/kg | Concentration after distillation with M, µg/kg | Concentration after distillation with M1. µg/kg | Concentration after distillation with M2. µg/kg |
|---|---|---|---|---|
| PBDE 47 | 4.8 | 0.7 | 0.1 | 0.05 |
| PBDE 99 | 3.6 | 0.6 | 0.08 | <0.01 |
| PBDE 119 | 2.3 | 0.4 | 0.06 | <0.01 |
| PBDE 153 | 1.8 | 0.5 | 0.07 | <0.01 |
| Total PBDE | 12.5 | 2.2 | 0.31 | 0.08 |

The distillations with the composition M, M1 or M2 as the carrier fluid were replicated three additional times under the conditions of Example 2, and the mean and the standard deviation (n=4) for each of compositions M, M1, and M2 are shown are shown in Table 9.

TABLE 9

PCBs and PBDEs content in horse mackerel oil, before and after distillation with different carrier fluid compositions. The values after distillation are expressed as the mean and the standard deviation (n = 4).

| Pollutant | Concentration before distillation | Concentration after distillation with M carrier fluid | Concentration after distillation with M1 carrier fluid | Concentration after distillation with M2 carrier fluid |
|---|---|---|---|---|
| PCBs TEQ (µg/kg) | 3.25 | 0.02125 ± 0.00263 | 0.008475 ± 0.001952 | 0.0009800 ± 0.0001804 |
| PBDEs (µg/kg) | 12.5 | 2.2750 ± 0.0957 | 0.3400 ± 0.0606 | 0.1025 ± 0.0403 |

Example 3

Example 3 shows a reduction in the concentration of pesticides (chlorinated hydrocarbons and toxaphenes or chlorinated camphenes) in salmon oil, by means of distillation with carrier fluids M1 and M2.

Salmon oil containing different pesticides (see Table 9) was mixed with the composition M, M1, or M2 as the carrier fluid at a weight ratio 8:100 of carrier fluid:salmon oil. The mixture was fed to a stainless steel short path distillation column model VK-83-6 (VTA GmbH) at a flow rate of 40 kg/h/m2 and was distilled at a temperature of 195° C. and a pressure of 0.003 mbar, obtaining a distilled oil residue containing pollutants at concentrations shown in Table 10.

TABLE 10

Pesticides content in salmon oil before and after distillation with different carrier fluid compositions.

| Chlorinated Hydrocarbon | Concentration before distillation μg/kg | Concentration after distillation with M, μg/kg | Concentration after distillation with M1, μg/kg | Concentration after distillation with M2, μg/kg |
|---|---|---|---|---|
| HCB | 4.1 | 0.7 | <0.2 | <0.2 |
| α-HCH | 6.8 | 0.8 | 0.6 | <0.2 |
| γ-HCH | 8.7 | 0.7 | 0.5 | 0.3 |
| β-HCH | 16.1 | 2.8 | 0.6 | 0.5 |
| p, p'-DDE | 71.4 | 2.1 | 1.9 | 1.5 |
| p, p'-DDD | 10.5 | 1.8 | 1.6 | 1.2 |
| p, p'-DDT | 22.7 | 5.3 | 0.4 | <0.2 |
| Total Chlorinated Hydrocarbon | 136.2 | 12.4 | 5.9 | 4.1 |

| Chlorinated camphenes | Concentration before distillation μg/kg | Concentration after distillation with M, μg/kg | Concentration after distillation with M1, μg/kg | Concentration after distillation with M2, μg/kg |
|---|---|---|---|---|
| Toxaphene 26 | 30 | 28 | 5.8 | 2.6 |
| Toxaphene 50 | 80 | 74 | 8.6 | 4.2 |
| Toxaphene 62 | 42 | 39 | 6.8 | 3.1 |
| Total Toxaphenes | 152 | 130 | 10.2 | 5.9 |

The distillations with the composition M, M1 or M2 as the carrier fluid were replicated three additional times under the conditions of Example 3, and the mean and the standard deviation (n=4) for each of compositions M, M1, and M2 are shown in Table 11.

TABLE 11

Pesticides content in salmon oil before and after distillation with different carrier fluid compositions. The values after distillation are expressed as the mean and the standard deviation (n = 4).

| Pollutant | Concentration before distillation | Concentration after distillation with M carrier fluid | Concentration after distillation with M1 carrier fluid | Concentration after distillation with M2 carrier fluid |
|---|---|---|---|---|
| Chlorinated Hydrocarbon μg/kg | 136.2 | 12.625 ± 0.634 | 5.300 ± 0.497 | 4.050 ± 0.404 |
| Toxaphenes μg/kg | 152 | 128.500 ± 4.203 | 10.300 ± 0.648 | 6.200 ± 0.469 |

Example 4

Example 4 shows a reduction in the concentration of polycyclic aromatic hydrocarbons (PAH) in cod liver oil, by means of distillation with carrier fluids M1 and M2.

Cod liver oil containing different PAHs (see Table 11) was mixed with composition M, M1, or M2 as the carrier fluid at a weight ratio 6:100 of carrier fluid:cod liver oil. The mixture was fed to a stainless steel short path distillation column model VK-83-6 (VTA GmbH) at a flow rate of 30 kg/h/m2 and was distilled at a temperature of 185° C. and a pressure of 0.002 mbar, obtaining a distilled oil residue containing PAHs at concentrations shown in Table 12.

TABLE 12

PAHs content in cod liver oil before and after distillation with different carrier fluid compositions

| Compound | Concentration before distillation μg/kg | Nisbet and LaGoy Factor* | Concentration after distillation with M carrier fluid, μg/kg | Concentration after distillation with M1 carrier fluid, μg/kg | Concentration after distillation with M2 carrier fluid, μg/kg |
|---|---|---|---|---|---|
| Acenaphtene | 0.35 | 0.001 | 0.18 | 0.10 | 0.08 |
| Acenonaphtalene | 6.40 | 0.001 | 2.80 | 0.80 | 0.64 |
| Anthracene | 19.30 | 0.01 | 3.40 | 2.40 | 1.12 |
| Benzo-(a)-anthracene | 0.80 | 0.1 | 0.28 | 0.20 | 0.10 |
| Benzo-(a)-pyrene | 5.20 | 1 | 0.40 | 0.12 | 0.10 |
| Chrysene | 3.20 | 0.01 | 1.37 | 0.40 | 0.30 |
| Fluoranthene | 2.90 | 0.001 | 0.97 | 0.37 | 0.20 |
| Fluorene | 8.40 | 0.001 | 1.28 | 0.66 | 0.40 |
| Total | 46.55 | | 10.68 | 5.05 | 2.94 |
| Total BaP equivalent | 5.52 | | 0.48 | 0.17 | 0.12 |

* Nisbet et al. (1992) Toxic Equivalency Factors (TEFs) for Polycyclic Aromatic Hydrocarbons (PAHs). Regulatory Toxicology and Pharmacology 16, 290-300.

The distillations with the compositions M, M1 or M2 as carrier fluid were replicated three additional times under the conditions of Example 4, and the mean and the standard deviation (n=4) for each of compositions M, M1, and M2 are shown in Table 13.

TABLE 13

PAHs content in cod liver oil, before and after distillation with different carrier fluid compositions. The values after distillation are expressed as the mean and the standard deviation (n = 4).

| Pollutant | Concentration before distillation | Concentration after distillation with M carrier fluid | Concentration after distillation with M1 carrier fluid | Concentration after distillation with M2 carrier fluid |
|---|---|---|---|---|
| PAHs BaP equivalent μg/kg | 5.52 | 0.4950 ± 0.0342 | 0.1925 ± 0.0263 | 0.1175 ± 0.0171 |

Example 5

Example 5 shows a reduction in PCB 209 congener concentration in salmon oil by means of distillation with carrier fluid M1 and M2. PCB 209 is the least volatile of PCB congeners and the extent of its reduction in fish oil is indicative of the carrier fluid efficiency for reducing low-volatility POPs.

PCB 209 was added to the distilled salmon oil from example 3 until a concentration of 0.45 mg/kg, and then the oil enriched in PCB 209 was mixed with composition M, M1, or M2 as the carrier fluid at a weight ratio 8:100 of carrier fluid:salmon oil. The mixture was fed to a stainless steel molecular distiller model VK-83-6 (VTA GmbH) at a flow rate of 40 kg/h/m2 and distilled at a temperature of 190° C. and a pressure of 0.002 mbar. The results of the distillations are shown in Table 14.

TABLE 14

PCB-209 content in salmon oil before and after distillation with different carrier fluids.

| Pollutant | Concentration before distillation | Concentration after distillation with M carrier fluid mg/kg | Concentration after distillation with M1 carrier fluid mg/kg | Concentration after distillation with M2 carrier fluid mg/kg |
|---|---|---|---|---|
| PCB-209 | 0.45 | 0.012 | 0.005 | 0.001 |

The distillations with composition M, M1 or M2 as carrier fluid were replicated three additional times under the conditions of Example 5, and the mean and the standard deviation (n=4) for each of compositions M, M1, and M2 are shown in Table 15.

TABLE 15

PCB-209 content in salmon oil before and after distillation with different carrier fluid compositions. The values after distillation are expressed as the mean and the standard deviation (n = 4).

| Pollutant | Concentration before distillation | Concentration after distillation with M carrier fluid | Concentration after distillation with M1 carrier fluid | Concentration after distillation with M2 carrier fluid |
|---|---|---|---|---|
| PCB-209 mg/kg | 0.45 | 0.01750 ± 0.00404 | 0.01050 ± 0.003873 | 0.00425 ± 0.00299 |

Table 16 shows a summary of the results obtained in Examples 1-5 for each pollutant group (n=4 for each carrier fluid). The percentage of pollutant reduction is shown in the parenthesis. For PBCs, the first value in parentheses shows the reduction in TEQ μg/kg, and the second value in the parentheses shows the physical reduction in μg/kg.

TABLE 16

| Pollutant | Concentration in fish oil before distillation | Concentration in fish oil after distillation with M carrier fluid | Concentration in fish oil after distillation with M1 carrier fluid | Concentration in fish oil after distillation with M2 carrier fluid |
|---|---|---|---|---|
| Dioxins TEQ ng/kg | 2.86 | 0.2725 (90.4) | 0.1975 (93.1) | 0.1125 (96.1) |
| Furans TEQ ng/kg | 6.58 | 0.6150 (87.7) | 0.3025 (95.4) | 0.1300 (98) |
| PCBs TEQ μg/kg | 3.25 | 0.02125 (99.3; 79.6) | 0.008475 (99.7; 96.8) | 0.000980 (99.96; 99.4) |
| PBDEs μg/kg | 12.5 | 2.2750 (81.8) | 0.3400 (97.3) | 0.1025 (99.2) |
| PCB-209 mg/kg | 0.45 | 0.01750 (96.1) | 0.01050 (97.6) | 0.00425 (99) |
| PAHsBaP equivalent μg/kg | 5.52 | 0.4950 (91.0) | 0.1925 (96.5) | 0.1175 (97.9) |

TABLE 16-continued

| Pollutant | Concentration in fish oil before distillation | Concentration in fish oil after distillation with M carrier fluid | Concentration in fish oil after distillation with M1 carrier fluid | Concentration in fish oil after distillation with M2 carrier fluid |
|---|---|---|---|---|
| Chlorinated pesticides μg/kg | 136.2 | 12.625 (90.7) | 5.300 (96.1) | 4.050 (97) |
| Toxaphenes μg/kg | 152 | 128.500 ± 4.203 (15.5) | 10.300 ± 0.648 (93.2) | 6.200 ± 0.469 (95.9) |

Example 6

Example 6 shows the effect of the nature and total concentration of unsaturated fatty acid ethyl esters in the carrier fluid composition on the reduction of POPs concentration in fish oils.

Examples 1 to 5 were repeated with additional embodiments of carrier fluid compositions of the disclosure. Composition M3 is an embodiment of carrier fluid composition CF1 of the disclosure with a content of unsaturated fatty acids of 76.5% by weight, mostly monounsaturated. Composition M4 is an embodiment of carrier fluid composition CF2 of the disclosure with a content of unsaturated fatty acids of 79.5% by weight, mostly monounsaturated. The composition of carrier fluids M3 and M4 is shown in Table 17.

TABLE 17

Carrier fluids compositions used in Example 6

| Component | M3 (% by weight) | M4 (% by weight) |
|---|---|---|
| Tetradecanoic Acid Ethyl Ester (Myristic Acid C14:0) | 12.0 | 11.4 |
| Palmitic Acid Ethyl Ester (C16.0) | 9.0 | 8.5 |
| Palmitoleic Acid Ethyl Ester (C16:1) | 34.0 | 32.3 |
| Stearic Acid Ethyl Ester (C18:0) | 1.0 | 0.9 |
| Oleic Acid Ethyl Ester (C18.1) | 19.5 | 18.5 |
| Linoleic Acid Ethyl Ester (C18:2n6 ) | 5.0 | 4.7 |
| α- Linolenic Acid Ethyl Ester (C18:3n3) | 0.5 | 0.5 |
| γ- Linolenic Acid Ethyl Ester (C18:3n6) | 0.1 | 0.1 |
| Stearidonic Acid Ethyl Ester (Acid Moroctic C18:4n3) | 5.0 | 4.7 |
| Eicosanoic Acid Ethyl Ester (Arachidic Acid (C20:0)) | 1.0 | 0.9 |
| Eicosenoic Acid Ethyl Ester (Gondoic Acid (C20:1n9)) | 2.0 | 1.9 |
| Eicosadienoic Acid Ethyl Ester (C20:2n6) | 0.2 | 0.2 |
| Eicosatrienoic Acid Ethyl Ester (C20:3n3) | 0.2 | 0.2 |
| Eicosatrienoic Acid Ethyl Ester (Dihomo - γ-Linolenic Acid (C20:3n6)) | 0.1 | 0.1 |
| Eicosatetraenoic Acid Ethyl Ester ( Araquidonic Acid (C20:4n6)) | 2.0 | 1.9 |
| Eicosapentaenoic Acid Ethyl Ester (C20:5n3) | 5.0 | 4.7 |
| Docosanoic Acid Ethyl Ester (Behenic Acid C22:0) | 0.5 | 0.5 |
| Cetoleic Acid Ethyl Ester (C22:1n11) | 0.0 | 0.0 |
| Erucic Acid Ethyl Ester (C22:1n9) | 0.0 | 0.0 |

TABLE 17-continued

| Carrier fluids compositions used in Example 6 | | |
|---|---|---|
| Component | M3 (% by weight) | M4 (% by weight) |
| Docosadienoic Acid Ethyl Ester (C22:2 Cis 13,16) | 0.5 | 0.5 |
| Docosapentaenoic Acid Ethyl Ester (C22:5n3) | 0.5 | 0.5 |
| Docosahexaenoic Acid Ethyl Ester (C22:6n3) | 1.0 | 0.9 |
| Tetracosanoic Acid Ethyl Ester (Lignoceric Acid C24:0) | 0.0 | 0.0 |
| Tetracosaenoic Acid Ethyl Ester (Nervonic Acid C24:1) | 0.0 | 0.0 |
| Eicosapentaenoic Acid (C20:5) | 0.0 | 5.0 |

Examples 1-5 were replicated using the carrier fluid compositions shown in Table 17. The results obtained with M3 and M4 were of the same order of magnitude as the results for M1 and M2 shown in Table 16. Individual variations of ±25% in relation to values in Table 16 were observed. The data for carrier fluids M1, M2, M3, and M4 corroborate the superior efficiency of fatty acids ethyl ester mixtures containing at least 75% of unsaturated acids ethyl ester, either mono or poly-unsaturated, as carrier fluids for reducing the concentration of PCBs and PTSs in fish oils compared to conventional ethyl ester type carrier fluids, which contain about 50% by weight or less of unsaturated acids ethyl esters.

The results shown in Examples 1-6 validate the superior efficiency of the carrier fluid compositions CF1 and CF2 of the disclosure over conventional carrier fluids, such as the type disclosed in EP 1523541 B1 for the removal of persistent organic pollutants in fish oils by means of vacuum distillation. The results obtained in Examples 1-6 with carrier fluid compositions M1, M2, M3, and M4 were surprising and unexpected as the existence of significant differences of the magnitude observed in Examples 1-6 related to the efficiency of different fatty acid ethyl esters compositions as carrier fluids for the removal of persistent organic pollutants from fish oils by means of vacuum distillation or the efficiency enhancing effect of eicosapentaenoic acid has not been previously disclosed or suggested.

Although the conventional carrier fluid compositions achieved POPs and toxaphene concentrations that were less than the maximum permitted limits, the results shown in Examples 1-6 demonstrate that the carrier fluids of the disclosure are capable of further significant reductions in the concentrations of dioxans, furans, PBDEs, PAHs and BaP, chlorinated hydrocarbons, and toxaphenes. See Table 16. In particular, the reduction in PCB, PBDE, and toxaphene concentrations obtained with the carrier fluid compositions of the disclosure was almost an order of magnitude greater than the reduction obtained with the conventional carrier fluid. The significant improvement in toxaphene reducing efficiency is most striking. Under the operational conditions used in the examples, the conventional carrier fluid decreased the concentration of toxaphenes by only 15.5%. In stark contrast, carrier fluid compositions CF1 and CF2 decreased the concentration of toxaphenes by 93.2% and 95.9%, respectively, under the same operating conditions as the conventional carrier fluid. See Table 16.

Recent studies regarding the clinical use of eicosapentaenoic acid esters (EPA) and docosahexanoic acid esters (DHA) recommend doses of several grams of said esters for daily consumption. As the recommended dosage of EPA and DHA for clinical use increases, reducing pollutant levels in fish oils, which are important sources for EPA and DHA, has increasingly become more important as the daily consumption of fish oils increases. Moreover, the maximum permissible levels of POPs and PTSs allowed by government agencies/regulatory agencies in consumable products, such as fish oils, have been decreasing as the understanding of the toxic effects of POPs and PTSs increases. Therefore, in the near future it may be necessary to further decrease the concentration levels of increase POPs to comply with new or revised regulations. While conventional carrier fluids of the type tested in the Examples are generally capable of meeting current requirements, a further reduction in the maximum allowable concentration of POPs and/or PTSs in fish oils would likely require an additional purification process, such as adsorbents treatment, to comply with the reduced maximum allowable concentrations.

The carrier fluid compositions of the disclosure not only comply with the existing regulations but have the capacity to comply with more demanding regulations that likely will arise in the future. As shown in Examples 1-6, the carrier fluid compositions of the disclosure and the processes disclosed herein efficiently remove a broader spectrum of pollutants from fish oils than processes that use active carbon adsorption and remove a significantly higher proportion of POPs than known carrier fluids under similar processing conditions.

What is claimed is:

1. A carrier fluid composition for reducing persistent organic pollutants concentration in fish oils in a vacuum distillation process, wherein the composition comprises the following fatty acid ethyl esters:

| Fatty acid ethyl ester | Composition concentration range (% by weight) |
|---|---|
| Eicosenoic Acid Ethyl Ester (Gondoic Acid (C20:1n9)) | 0.1-10 |
| Eicosadienoic Acid Ethyl Ester (C20:2n6) | 0.1-20 |
| Eicosatrienoic Acid Ethyl Ester (C20:3n3) | 0.1-20 |
| Eicosatrienoic Acid Ethyl Ester or Dihomo-γ-Linolenic Acid (C20:3n6) | 0.1-20 |
| Eicosapentaenoic Acid Ethyl Ester (C20:5n3) | 0.1-80 |
| Docosahexaenoic Acid Ethyl Ester (C22:6n3) | 0.1-80. |

2. The carrier fluid composition according to claim 1, wherein the composition additionally comprises at least one of the followings fatty acid ethyl esters:

| Fatty acid ethyl ester | Composition maximum concentration (% by weight) |
|---|---|
| Tetradecanoic Acid Ethyl Ester (Myristic Acid C14:0) | 20 |
| Palmitic Acid Ethyl Ester (C16.0) | 15 |
| Palmitoleic Acid Ethyl Ester (C16:1) | 40 |
| Stearic Acid Ethyl Ester (C18:0) | 5 |
| Oleic Acid Ethyl Ester (C18.1) | 30 |
| Linoleic Acid Ethyl Ester (C18:2n6 ) | 10 |
| α- Linolenic Acid Ethyl Ester (C18:3n3) | 5 |
| γ- Linolenic Acid Ethyl Ester (C18:3n6) | 5 |
| Stearidonic Acid Ethyl Ester (Acid Moroctic C18:4n3) | 15 |
| Eicosanoic Acid Ethyl Ester (Arachidic Acid (C20:0)) | 15 |

-continued

| Fatty acid ethyl ester | Composition maximum concentration (% by weight) |
|---|---|
| Eicosatetraenoic Acid Ethyl Ester or Araquidonic Acid (C20:4n6) | 20 |
| Docosanoic Acid Ethyl Ester (Behenic Acid C22:0) | 5 |
| Cetoleic Acid Ethyl Ester (C22:1n11) | 10 |
| Erucic Acid Ethyl Ester (C22:1n9) | 20 |
| Docosadienoic Acid Ethyl Ester (C22:2 Cis 13,16) | 20 |
| Docosapentaenoic Acid Ethyl Ester (C22:5n3) | 30 |
| Tetracosanoic Acid Ethyl Ester (Lignoceric Acid C24:0) | 5 |
| Tetracosaenoic Acid Ethyl Ester (Nervonic Acid C24:1) | 5 |

wherein at least 75% by weight of the composition comprises unsaturated fatty acid ethyl esters.

3. The carrier fluid composition according to claim 1, further comprising from 0.5 to 5% by weight of eicosapentaenoic acid.

4. The carrier fluid composition according to claim 2, further comprising from 0.5 to 5% by weight of eicosapentaenoic acid.

5. The carrier fluid composition of claim 4, wherein at least 75% by weight of the composition comprises unsaturated fatty acid ethyl esters.

6. A process for reducing the persistent organic pollutants (POPs) concentration in fish oils, the process comprising:

(a) contacting fish oil with a carrier fluid composition of claim 1 to form a mixture of fish oil and the carrier fluid composition, wherein said mixture comprises from about 1 to about 10% by weight of the carrier fluid composition;

(b) feeding the mixture into a short-path distillation column comprising an evaporator to generate a distillate and a residue; and (c) collecting the residue from the column, wherein the residue comprises fish oil having a POPs concentration that is less than the POPs concentration present in the fish oil prior to contacting the fish oil with the carrier fluid composition.

7. The process according to claim 6, wherein the column comprises a pressure between 0.0001 and 0.5 mbar and the evaporator comprises a temperature between 150° C. and 280° C.

8. The process according to claim 7, wherein column comprises a pressure between 0.001 and 0.05 mbar and the evaporator comprises a the temperature between 180° C. and 240° C.

9. The process according to claim 6, wherein the carrier fluid composition additionally comprises at least one of the followings fatty acid ethyl esters:

| Fatty acid ethyl ester | Composition maximum concentration (% by weight) |
|---|---|
| Tetradecanoic Acid Ethyl Ester (Myristic Acid C14:0) | 20 |
| Palmitic Acid Ethyl Ester (C16.0) | 15 |
| Palmitoleic Acid Ethyl Ester (C16:1) | 40 |

-continued

| Fatty acid ethyl ester | Composition maximum concentration (% by weight) |
|---|---|
| Stearic Acid Ethyl Ester (C18:0) | 5 |
| Oleic Acid Ethyl Ester (C18.1) | 30 |
| Linoleic Acid Ethyl Ester (C18:2n6 ) | 10 |
| α- Linolenic Acid Ethyl Ester (C18:3n3) | 5 |
| γ- Linolenic Acid Ethyl Ester (C18:3n6) | 5 |
| Stearidonic Acid Ethyl Ester (Acid Moroctic C18:4n3) | 15 |
| Eicosanoic Acid Ethyl Ester (Arachidic Acid (C20:0)) | 15 |
| Eicosatetraenoic Acid Ethyl Ester or Araquidonic Acid (C20:4n6) | 20 |
| Docosanoic Acid Ethyl Ester (Behenic Acid C22:0) | 5 |
| Cetoleic Acid Ethyl Ester (C22:1n11) | 10 |
| Erucic Acid Ethyl Ester (C22:1n9) | 20 |
| Docosadienoic Acid Ethyl Ester (C22:2 Cis 13,16) | 20 |
| Docosapentaenoic Acid Ethyl Ester (C22:5n3) | 30 |
| Tetracosanoic Acid Ethyl Ester (Lignoceric Acid C24:0) | 5 |
| Tetracosaenoic Acid Ethyl Ester (Nervonic Acid C24:1) | 5 |

wherein at least 75% by weight of the composition comprises unsaturated fatty acid ethyl esters.

10. The process according to claim 9, wherein the column comprises a pressure between 0.0001 and 0.5 mbar and the evaporator comprises a temperature between 150° C. and 280° C.

11. The process according to claim 10, wherein column comprises a pressure between 0.001 and 0.05 mbar and the evaporator comprises a temperature between 180° C. and 240° C.

12. A process for reducing the persistent organic pollutants (POPs) concentration in fish oils, the process comprising:

(d) contacting fish oil with a carrier fluid composition of claim 3 to form a mixture of fish oil and the carrier fluid composition, wherein said mixture comprises from about 1 to about 10% by weight of the carrier fluid composition;

(e) feeding the mixture into a short-path distillation column comprising an evaporator to generate a distillate and a residue; and (f) collecting the residue from the column, wherein the residue comprises fish oil having a POPs concentration that is less than the POPs concentration present in the fish oil prior to contacting the fish oil with the carrier fluid composition.

13. The process according to claim 12, wherein the column comprises a pressure between 0.0001 and 0.5 mbar and the evaporator comprises a temperature between 150° C. and 280° C.

14. The process according to claim 13, wherein column comprises a pressure between 0.001 and 0.05 mbar and the evaporator comprises a temperature between 180° C. and 240° C.

15. The process according to claim 12, wherein the carrier fluid composition additionally comprises at least one of the followings fatty acid ethyl esters:

| Fatty acid ethyl ester | Composition maximum concentration (% by weight) |
|---|---|
| Tetradecanoic Acid Ethyl Ester (Myristic Acid C14:0) | 20 |
| Palmitic Acid Ethyl Ester (C16.0) | 15 |
| Palmitoleic Acid Ethyl Ester (C16:1) | 40 |
| Stearic Acid Ethyl Ester (C18:0) | 5 |
| Oleic Acid Ethyl Ester (C18.1) | 30 |
| Linoleic Acid Ethyl Ester (C18:2n6 ) | 10 |
| α- Linolenic Acid Ethyl Ester (C18:3n3) | 5 |
| γ- Linolenic Acid Ethyl Ester (C18:3n6) | 5 |
| Stearidonic Acid Ethyl Ester (Acid Moroctic C18:4n3) | 15 |
| Eicosanoic Acid Ethyl Ester (Arachidic Acid (C20:0)) | 15 |
| Eicosatetraenoic Acid Ethyl Ester or Araquidonic Acid (C20:4n6) | 20 |
| Docosanoic Acid Ethyl Ester (Behenic Acid C22:0) | 5 |
| Cetoleic Acid Ethyl Ester (C22:1n11) | 10 |

-continued

| Fatty acid ethyl ester | Composition maximum concentration (% by weight) |
|---|---|
| Erucic Acid Ethyl Ester (C22:1n9) | 20 |
| Docosadienoic Acid Ethyl Ester (C22:2 Cis 13,16) | 20 |
| Docosapentaenoic Acid Ethyl Ester (C22:5n3) | 30 |
| Tetracosanoic Acid Ethyl Ester (Lignoceric Acid C24:0) | 5 |
| Tetracosaenoic Acid Ethyl Ester (Nervonic Acid C24:1) | 5 |

wherein at least 75% by weight of the composition comprises unsaturated fatty acid ethyl esters.

16. The process according to claim 15, wherein the column comprises a pressure between 0.0001 and 0.5 mbar and the evaporator comprises a temperature between 150° C. and 280° C.

17. The process according to claim 16, wherein column comprises a pressure between 0.001 and 0.05 mbar and the evaporator comprises a temperature between 180° C. and 240° C.

* * * * *